US006415891B1

(12) United States Patent
Hayman et al.

(10) Patent No.: US 6,415,891 B1
(45) Date of Patent: Jul. 9, 2002

(54) SCAFFOLD STAIR

(76) Inventors: Yates Westley Hayman, 39455 John Lanier Rd., Walker, LA (US) 70785; Kenneth Ray Hensley, 45430 Irah Rd., St. Amant, LA (US) 70774

( * ) Notice: Subject to any disclaimer, the term of this patent is extended or adjusted under 35 U.S.C. 154(b) by 0 days.

(21) Appl. No.: 09/709,115

(22) Filed: Nov. 8, 2000

(51) Int. Cl.[7] ..... E04G 7/00

(52) U.S. Cl. ..... 182/178.1; 182/194; 52/182; 52/183

(58) Field of Search ..... 182/120, 121, 182/122, 129, 93, 97, 178.1, 194; 52/182, 183

(56) References Cited

U.S. PATENT DOCUMENTS 553,487 A * 1/1896 Godfrey ..... 182/194
3,099,336 A * 7/1963 Hawkins ..... 182/178.1 X
3,565,212 A * 2/1971 Johnson ..... 182/222
3,713,511 A * 1/1973 Hinkle ..... 182/95
3,837,427 A * 9/1974 Mattinson ..... 182/115
4,053,028 A * 10/1977 Loix ..... 182/1
4,457,398 A * 7/1984 Loix ..... 182/151
4,586,585 A * 5/1986 Zaner ..... 182/97
4,586,586 A * 5/1986 Canals ..... 182/118
4,631,880 A * 12/1986 Leicht ..... 52/105
4,959,935 A * 10/1990 Stob ..... 52/183
5,010,699 A * 4/1991 Maiuccoro ..... 52/169.8
5,014,475 A * 5/1991 Anderson, Jr. et al. ..... 52/19
5,086,595 A * 2/1992 Maiuccoro et al. ..... 52/183
5,692,581 A * 12/1997 Nelson et al. ..... 182/129
5,988,318 A * 11/1999 Krause ..... 182/222

* cited by examiner

*Primary Examiner*—Bruce A. Lev
(74) *Attorney, Agent, or Firm*—Jones, Walker, Waechter, Poitevent, Carrere & Denegre, L.L.P.

(57) ABSTRACT

A scaffold stringer which is plate and a series of tread mounts attached at substantially uniform distances along the plate, the tread mounts forming an angle with the plate, each tread mount having an associated finger projection positioned above each tread mount and projecting outwardly from the stringer, the scaffold stringer additionally has least one attachment member for attaching the stringer to a scaffold structure.

19 Claims, 7 Drawing Sheets

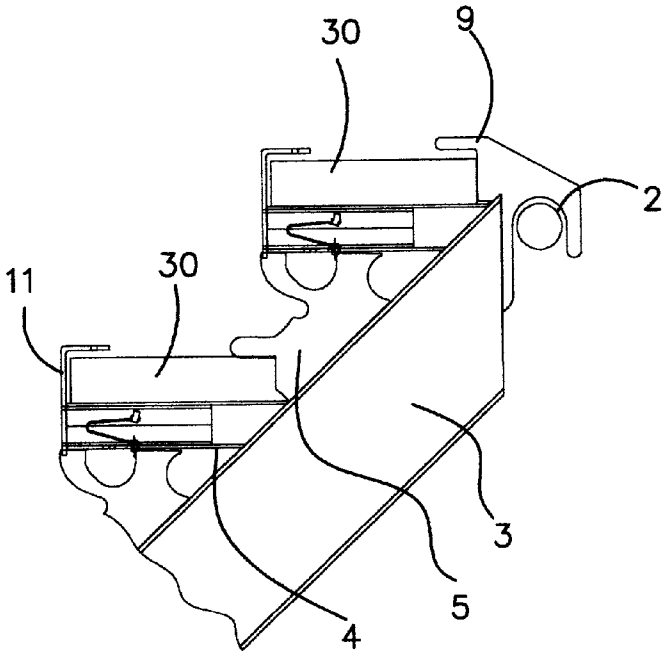
FIG 3B
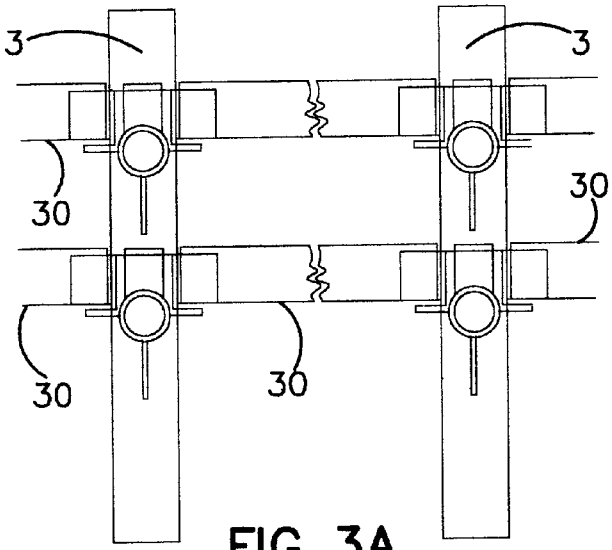
FIG 3A
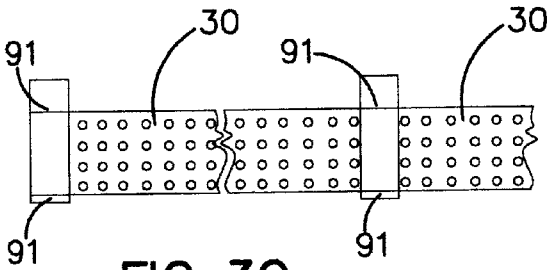
FIG 3C
FIGURE 3

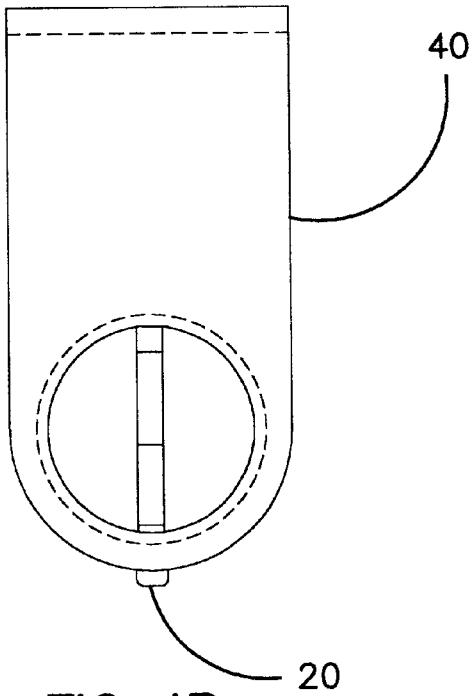
FIG 4B
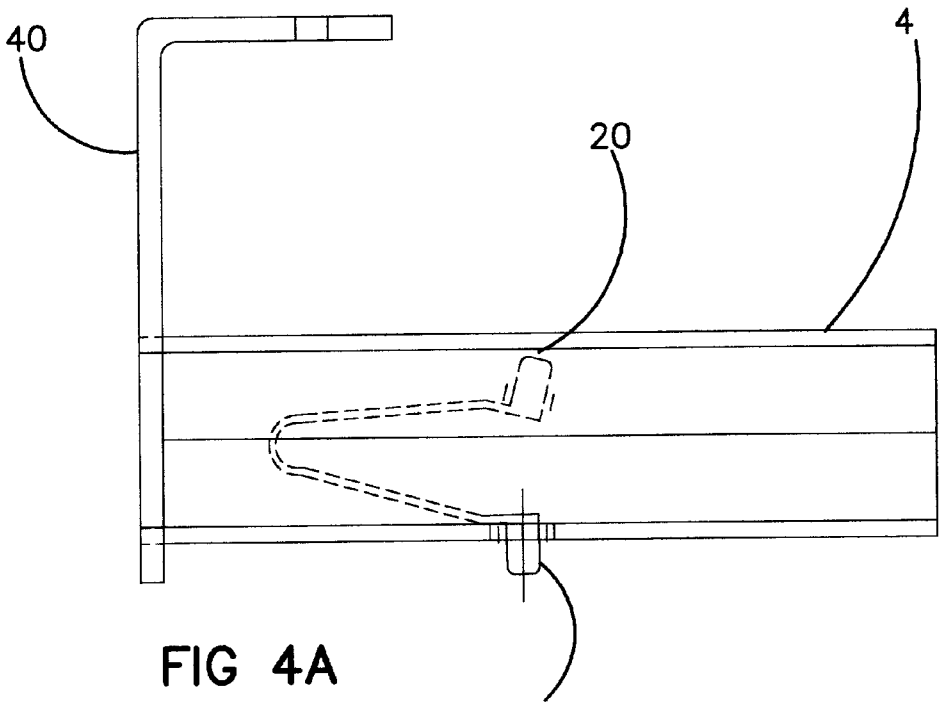
FIG 4A
FIGURE 4

SCAFFOLD STAIR

FIELD OF INVENTION

This invention relates to scaffold structures, and, in particular, to stairs for scaffold structures.

BACKGROUND OF THE INVENTION

Devices for accessing or mounting a scaffold platform generally consists of ladders, either added on to the structure of the scaffold structure or climbing the structure of the scaffold itself. That is, using the horizontal scaffold members as ladder rungs for climbing. Unfortunately, the climber is generally outside the scaffold structure in a fairly precarious situation. Upon reaching the deck, the climber must climb up the structure and swing his legs onto the deck, again in a precarious situation.

OBJECTS OF THE INVENTION

It is an object of the invention to provide a scaffold stair distinct from the scaffold structure.

It is an object of the invention to provide an easy to assemble scaffold stair.

It is an object of the invention to provide a scaffold stair with locks for holding stair treads in place.

It is an object of the invention to provide a scaffold stair system, which can be assembled into bleachers.

SUMMARY OF THE INVENTION

A scaffold stair having stringers and a series of tread mounts attached at substantially uniform distances along the stringer, each tread mount has an associated finger projection, said finger projection being positioned above each tread mount and projecting away from the stringer. Each stringer has an attachment member for attaching the stringer to a scaffold structure. The scaffold stairs additionally having a series of treads positioned on the tread mounts.

BRIEF DESCRIPTION OF THE DRAWINGS

FIG. 3A is a front view of the scaffold stairs set up as a seat.

FIG. 3B is a side view of a scaffold stair stringer showing details of the latch mechanism.

FIG. 3C is a top view of a scaffold stair tread.

FIG. 4A is a side view of the latch mechanism.

FIG. 4B is a front view of the latch mechanism.

DETAILED DESCRIPTION OF THE INVENTION

Figure 1:
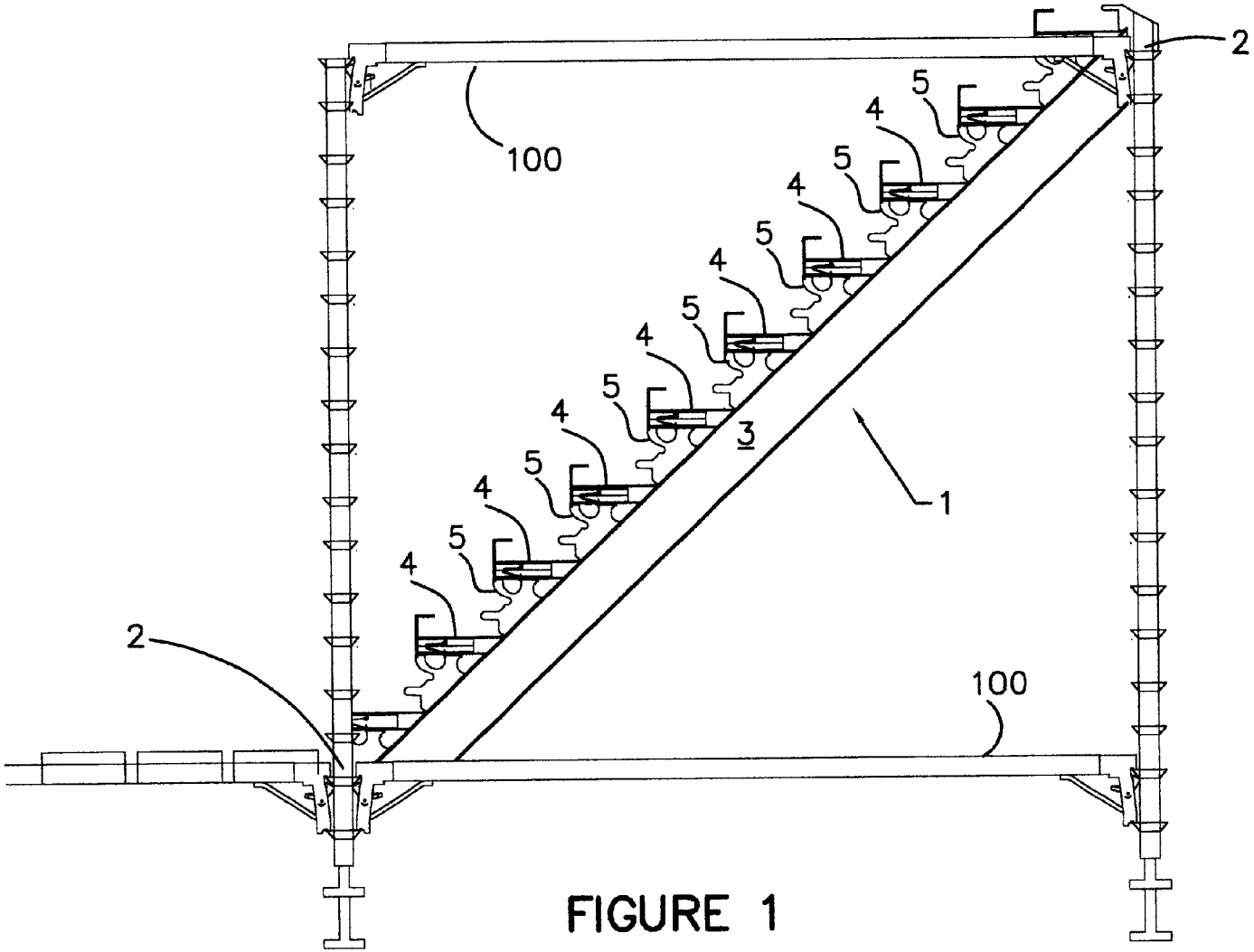
FIG. 1 depicts a side view of a scaffold structure with the scaffold stairs installed.

Scaffold stairs designed to be assembled in the field and attachable to a scaffold structure having horizontal members (100) and vertical members. In general, the stairs will be attachable to the structure's horizontal members. As shown in FIG. 1, the scaffold stairs include stair stringers 1, and a series of stair treads (30). Each stair stringer is a plate (5), with a series of tread mounts (4) positioned thereon. As shown, each tread mount (4) is a tube welded to the stringer (1), placed uniformly along the stringer (1). Additionally, as shown. plate member (5), attaches each tread mount (4) to the stringers (1). Plate member (5) provides additional support and rigidity to the tread mount/stringer connection.

Figure 5:
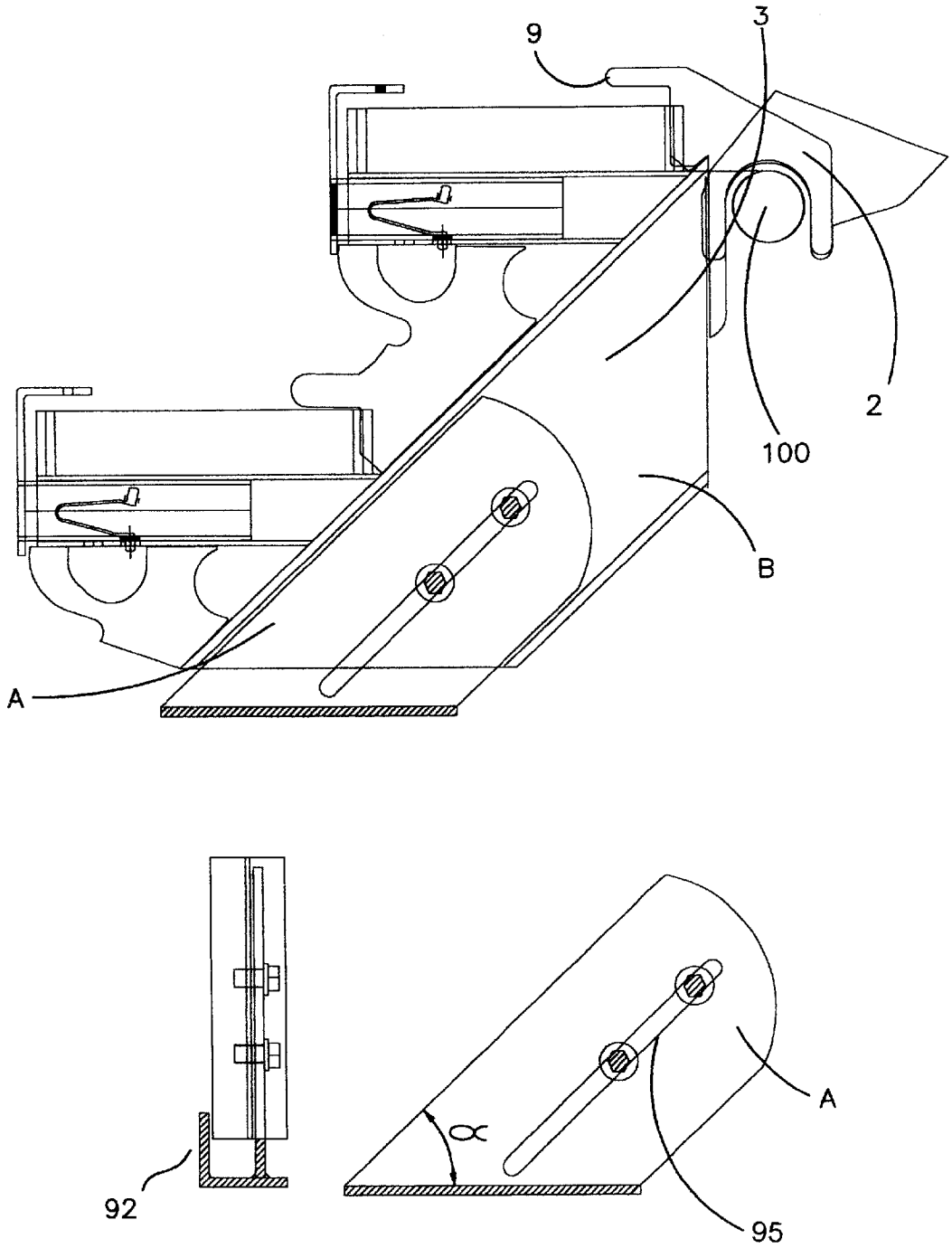
FIG. 5 is a side view of a ground contacting scaffold stair stringer.

Each stringer 3 has an attachment member 2 placed on at least one end for attaching to the scaffold structures, preferably the scaffold structure's horizontal members. As shown in FIG. 1, the attachment members 2 are hook shaped plates designed to latch or hook onto the horizontal scaffold members 100. As shown, the stringer 3 has two attachment members 2, one at each end. Some stringers 3 may have a single attachment member 2. For instance, the stringers of the stairs which rest on the ground obviously would not require an attachment member 2 at ground level, as is shown in FIG. 5.

Figure 2:
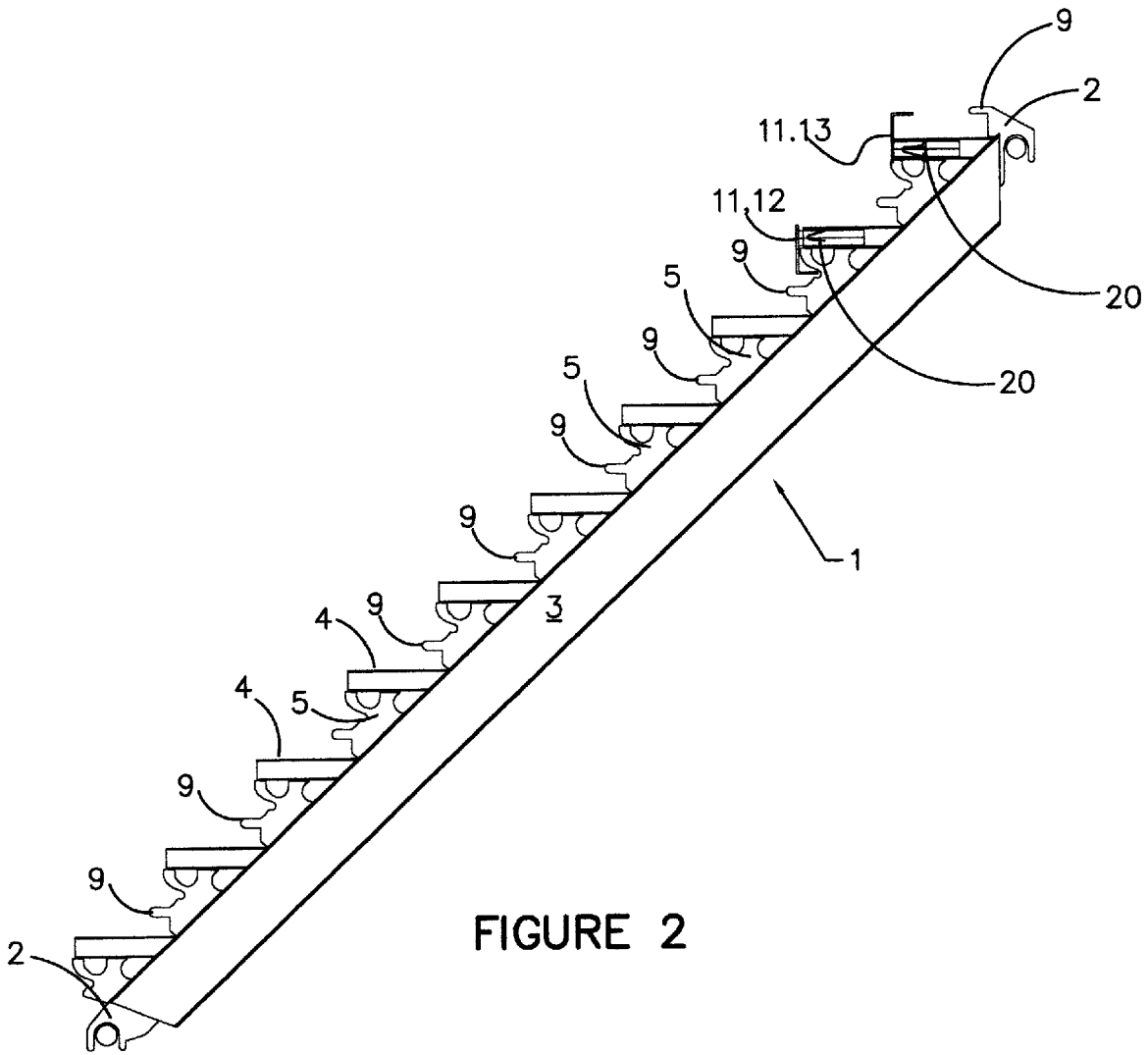
FIG. 2 is a detailed side view of one embodiment of a scaffold stair stringer.

As shown in FIG. 2, above each tread mount 30 is a projecting finger 9. Projecting finger 9, as shown, is part of a plate member 5, but the projecting finger 9 could be a separate member. The projecting finger 9 shown is "L" shaped. The back of the "L" is sized slightly larger than an expected tread thickness so that a tread 30 can be butted against the back of the "L", and have the top of the "L" project over the tread 30. In such a fashion, the projecting finger 9 acts to trap the tread between the projecting finger 9 and tread mount 4 and prevent upward movement and accidental dislodgment of the tread.

At the end of the tread mount 4 distal from the stringer 3 is a latch member 11. The latch member 11 is movably attached to the tread mount 4 between a first unlocked position 12 and a second locked position 13. As shown, the latch member 11 is a sleeve insertable into the tread mount 4 (see FIG. 4). The end of the sleeve is an "L" shaped bracket 40 for engaging the front of a stair tread when placed upon the tread mount. This sleeve is rotatable in the tread mount 4, and the latch members 11 position with respect to the tread mount 4 is fixed by buttons 20 which protrude through the sleeves outer surface and which are engagable with holes in the tread mount 4 (not shown). The latching mechanism shown included two buttons 20 positioned on the sleeve 180 degrees apart. The buttons are positioned on a clip that is insertable into the interior of the sleeve (see FIG. 4). Latch member sleeve 11 is rotatable between a first unlocked position 12 (the "L" orientated downward and riding in a slot cut in the plate) and a second locked position 13 (the "L" orientated upward to have the end of the "L" project over a tread mounted on the tread mounts). The sleeve may also be movable outwardly from the tread mount 4 (away from the stringer) to accommodate placement of the latch member sleeve 11 in the locked position (move sleeve outward, rotate up, and move inward to the locked position). Additionally, adjustment of the sleeve outwardly allows the operator to accommodate minor variations in stair tread sizes.

Shown in FIG. 3C is a top view of a tread 30 mounted on two stringers 3. As shown, each tread 30 is a metal plate having two hooks 91 at each end for attaching to the tread mounts 4. Obviously, the tread could be a wood board or board made from other materials. As shown, the treads 30 are constructed much like a metal scaffold board. The hooks 91 could be positioned below the tread 30 (not shown) to cover the tread mounts with the tread plate or foot contact area, or the hooks 91 may extend beyond the tread plate or foot contact area as is shown in FIG. 3. The arrangement in FIG. 3 allows two treads 30 to be placed side-by-side. In this fashion, a series of stringers 3 may be placed parallel to each other to form the structure of a bleacher or stands, with side-by-side treads 30 forming the seats of the stands.

Shown in FIG. 5 is a stringer 3 adapted for placement on the ground. The ground end of this stringer 3 has no hook section 2. Instead, the ground end is simply the stringer plate 3 cut at a suitable angle alpha. Alternatively, the ground level stringer 3 may be two plates that are adjustable with respect to each other. For instance, shown in FIG. 5 are plates A & B, where plate A has a slot 95 through which bolts are attached into plate B, thereby joining plates A & B in an adjustable manner. As shown, bottom-resting plate A also has a pad 92 on the ground side to increase the ground contact area. If the slots 95 are sufficiently wide, plate A can be adjusted to accommodate minor differences in the ground contact angle alpha.

Figure 6:
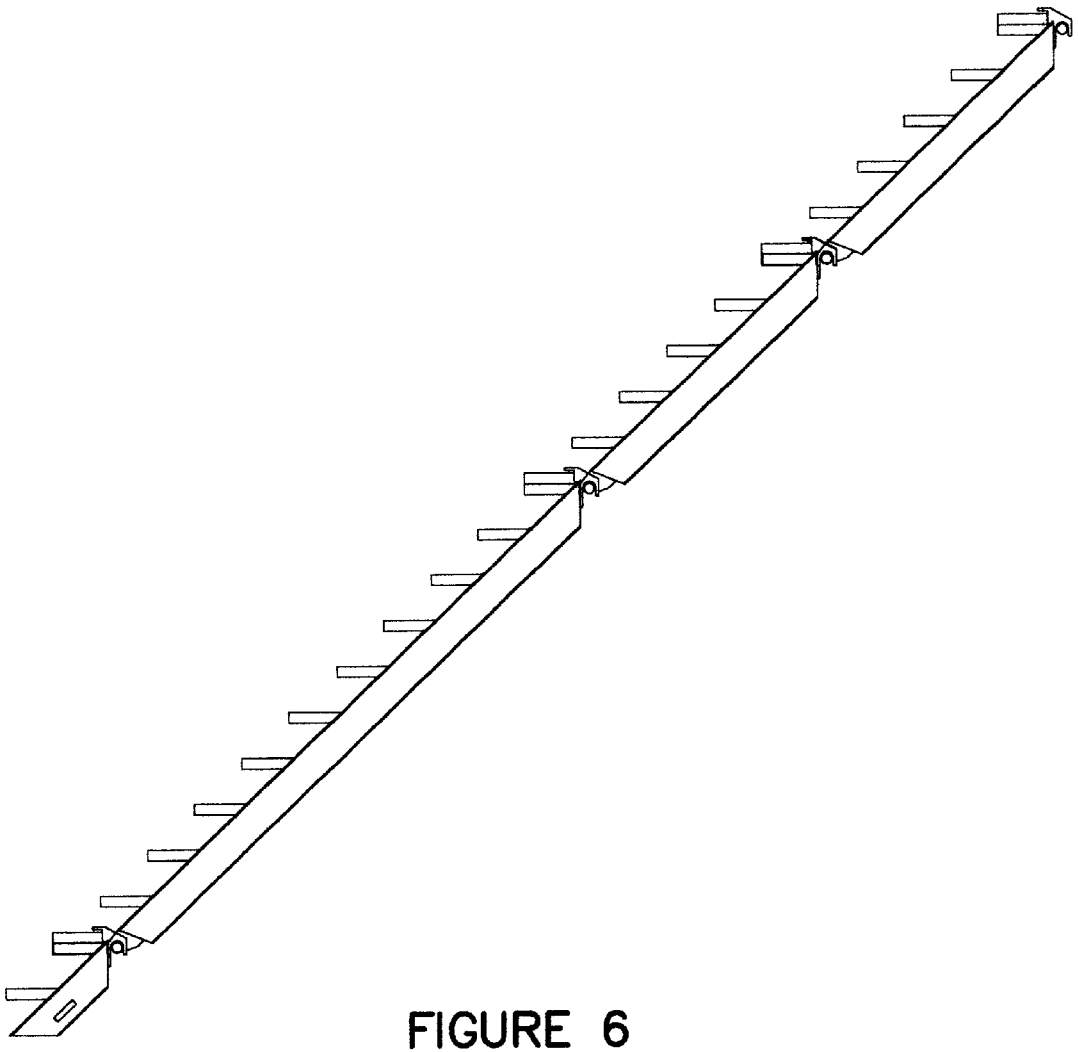
FIG. 6 is a side view of a series of scaffold stairs.
Figure 7:
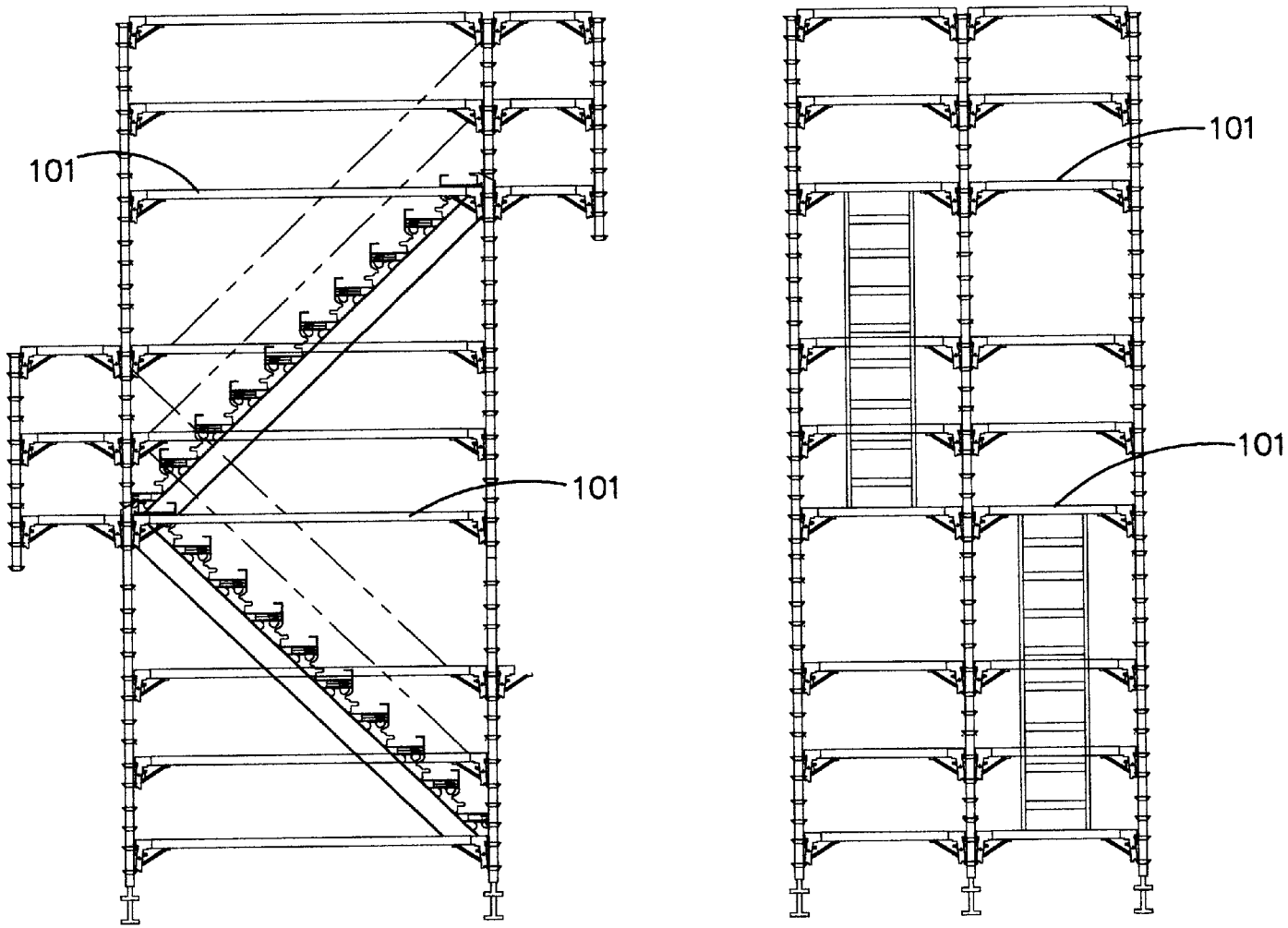
FIG. 7 shows two side views of the scaffold stairs in a switchback configuration.

Finally, a series of stringers can be assembled in conjunction with a scaffold frame to create a scaffold stair. If the scaffold structure is large enough, the stringers can be assembled into a continuous rise, as is shown in FIG. 6. If the scaffold structure is more spatially restrictive, the stairs may be assembled in a series of switchback sections, as is shown in FIG. 17. As indicated in FIG. 7, at each switchback, a deck 101 must be provided to allow the user to move from one stair riser section to the next. Additionally, as shown, the deck 101 will generally extend beyond the scaffold structure requiring the need for bracing of the extension and for safety railing.

Although the present invention has been described in terms of specific embodiments, it is anticipated that alterations and modifications thereof will no doubt become apparent to those skilled in the art which are intended to be included within the scope of the following claims.

We claim:

1. A scaffold stringer comprising a plate having two sides and an upper and a lower surface and a series of tread mounts attached at substantially uniform distances along said plate, each of said tread mounts forming an angle with said plate, a series of finger projections, each said finger projection being associated with a tread mount, said finger projection being positioned above each tread mount and projecting outwardly from said upper surface of said stringer to resist removal of a tread positioned on said tread mount by an upper force, said scaffold stringer further having at least one attachment member for attaching said stringer to a scaffold structure.

2. A scaffold stringer according to claim 1 further having a plurality of latches, each of said latches being attachable to one of said tread mounts, said latches, when attached to said tread mount, being adapted to retain a removable tread positioned across said tread mount against an upward force.

3. A scaffold stringer according to claim 2 wherein said latches are adapted to retain a removable tread by being movable with respect to said tread mount between a first locked location and a second unlocked location, wherein said latches retains a tread in said locked position but not in said unlocked position.

4. A scaffold stringer according to claim 3 wherein said latches are rotatable with respect to said tread mount.

5. A scaffold stringer according to claim 2 wherein each of said latches has an end plate that is "L" shaped.

6. A scaffold stringer according to claim 1 wherein said stringer further comprises two plates adjustably attachable to one another.

7. A scaffold stringer according to claim 6 wherein said latches are adapted to retain a removable tread by being movable with respect to said tread mount between a first locked location and a second unlocked location, wherein said latches retains a tread in said locked position but not in said unlocked position.

8. A scaffold stringer according to claim 7 wherein said latches are rotatable with respect to said tread mount.

9. A scaffold stringer according to claim 6 wherein each of said latches has an end plate that is "L" shaped.

10. A scaffold stringer according to claim 1 wherein said stringer further comprises two plates adjustably attachable to one another.

11. A scaffold stringer comprising a plate having two sides and an upper and a lower surface and a series of tread mounts attached at substantially uniform distances along said upper surface of said plate, each of said tread mounts forming an angle with said plate, said stringer further having a plurality of latches, each of said latches being attachable to one of said tread mounts, said latches, when attached to said tread mount, being adapted to retain a removable tread positioned across said tread mount against an upward force, said scaffold stringer further having at least one attachment member for attaching said stringer to a scaffold structure.

12. A scaffold stair attachable to a scaffold structure having vertical and horizontal members, said scaffold stair having at least two stringers, each stringer having two sides and an upper and a lower surface and a series of tread mounts attached at substantially uniform distances along said stringer, each of said tread mounts forming an angle with said plate, said stringers having a attachment member positioned on at least one end of said stringer, said attachment member adapted to engage a scaffold structure, said stringers having a series of finger projections, each said finger projection being associated with a tread mount, said finger projection being positioned above each tread mount and projecting outwardly from said upper surface of said stringer to resist removal of a tread positioned on said tread mount by an upper force, and a series of treads, each of said treads positionable across said tread mounts.

13. A scaffold stair according to claim 12 further having a plurality of latches, each of said latches being attachable to one of said tread mounts, said latches, when attached to said tread mount, being adapted to retain a removable tread positioned across said tread mount against an upward force.

14. A scaffold stair according to claim 13 wherein said latches are adapted to retain a removable tread by being movable with respect to said tread mount between a first locked location and a second unlocked location, wherein said latches retains a tread in said locked position but not in said unlocked position.

15. A scaffold stringer according to claim 14 wherein said latches are rotatable with respect to said tread mount.

16. A scaffold stair according to claim 13 wherein each of said latches has an end plate that is "L" shaped.

17. A scaffold stringer according to claim 12 wherein said stringer further comprises two plates adjustably attachable to one another.

18. A scaffold stair attachable to a scaffold structure having vertical and horizontal members, said scaffold stair having at least two stringers, each stringer having two sides and an upper and a lower surface and a series of tread mounts attached at substantially uniform distances along said upper surface of said stringer, each of said tread mounts forming an angle with said plate, said stringers having a attachment member positioned on at least one end of said stringer, said attachment member adapted to engage a scaffold structure, each tread mount having a latch, said latch attachable to said tread mount, said latches, when attached, being adapted to retain a removable tread positioned across said tread mount against an upward force.

19. A scaffold stair according to claim 18 wherein at least two of said stringers further comprises two plates adjustably attachable to one another.

* * * * *